United States Patent [19]

Schuierer

[11] 4,234,311

[45] Nov. 18, 1980

[54] PROCESSES FOR REMOVING IMPURITIES FROM TEXTILE MATERIALS

[75] Inventor: Manfred Schuierer, Michelstadt, Fed. Rep. of Germany

[73] Assignee: Bruckner Apparatebau GmbH, Erbach, Fed. Rep. of Germany

[21] Appl. No.: 52,349

[22] Filed: Jun. 27, 1979

Related U.S. Application Data

[63] Continuation-in-part of Ser. No. 861,532, Dec. 19, 1977, abandoned.

[51] Int. Cl.[2] ..... D01C 3/02; D06L 1/06; B08B 3/08

[52] U.S. Cl. ..... 8/138; 8/137; 8/137.5; 8/138; 8/139.1; 8/141; 8/149.3

[58] Field of Search ..... 8/137, 137.5, 138, 139.1, 8/141, 149.3

[56] References Cited

U.S. PATENT DOCUMENTS

| | | | |
|---|---|---|---|
| 3,575,686 | 4/1971 | Case et al. | 8/142 |
| 3,595,603 | 7/1971 | Cerana | 8/111 |
| 3,634,024 | 1/1972 | Yelin | 8/138 |
| 3,663,160 | 5/1972 | Stone et al. | 8/137 |
| 3,753,646 | 8/1973 | Hess et al. | 8/85 |
| 3,841,833 | 10/1974 | Minkema et al. | 8/138 |
| 3,960,485 | 6/1976 | Fantl et al. | 8/138 |
| 4,076,500 | 2/1978 | Rearick | 8/139.1 |

FOREIGN PATENT DOCUMENTS

| | | |
|---|---|---|
| 2656425 | 6/1978 | Fed. Rep. of Germany . |
| 1493972 | 12/1977 | United Kingdom . |

*Primary Examiner*—A. Lionel Clingman
*Attorney, Agent, or Firm*—Learman & McCulloch

[57] ABSTRACT

An aqueous solution containing impurities such as size is applied to a textile material and the textile material subsequently is exposed to treatment by an organic. solvent. Between the application of the aqueous solution and the exposure of the material to the solvent, the material is exposed to a saturated steam treatment in which the impurities are dissolved or degraded.

25 Claims, 3 Drawing Figures

PROCESSES FOR REMOVING IMPURITIES FROM TEXTILE MATERIALS

RELATED APPLICATION

Figure 1:
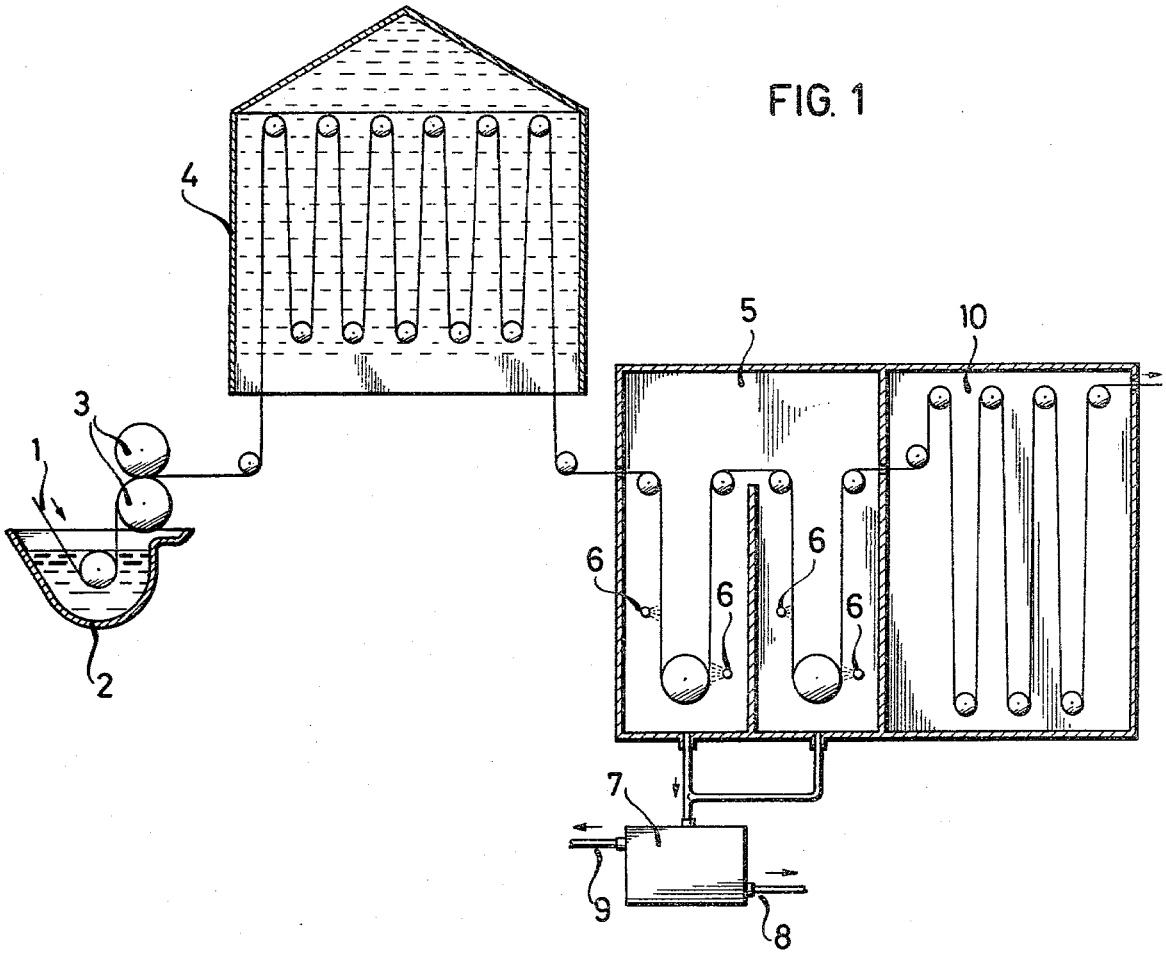

This application is a continuation-in-part of application Ser. No. 861,532, filed Dec. 19, 1977, and now abandoned.

This invention relates to a process for removing polymeric impurities from textile material, in which an aqueous solution is applied to the textile material and is subsequently displaced mechanically therefrom by an organic solvent.

In one process of this type, as disclosed in copending application Ser. No. 551,743, the aqueous solution remains in the liquid phase throughout the entire process. With the mechanical displacement of the aqueous solution by the organic solvent, the impurities are also satisfactorily removed from the textile material.

The object of the present invention is to further develop a process of this type to the extent that polymeric impurities soluble in water or degradable in water by means of additives (impurities such as these are present in particular in size and in dye thickening agents) can be removed satisfactorily and particularly inexpensively from the textile material.

According to the invention, this object is achieved in that, after the aqueous solution has been applied to the material and before the material is exposed to the organic solvent, the textile material is exposed to the action of saturated steam in a steaming zone.

It has been found that the dissolution or degradation of the polymeric impurities present in the textile material not only takes a certain time, but can also be very effectively assisted by a steaming process, i.e., by the action of saturated steam. The residence time of the textile material in the steaming zone may amount to between 10 seconds and 10 minutes, depending upon the nature of the textile material and the type and quantity of impurities present in it. In general, a steaming time of from 1 to 3 minutes will be optimal.

The use of saturated steam in the steaming zone is particularly advisable because evaporation of the water previously applied to the textile material is prevented.

Where the "impurities" to be removed from the textile material are substances which are intended to be reused (as is the case in particular with the removal of size from textile material), further development of the process according to the invention has proved to be of particular advantage. In cases such as these, it is of course desirable to obtain the size removed from the textile material in the form of an aqueous solution with the highest possible concentration because it is only in this form that the size solution can be reused without any need for additional thickening. Accordingly, in one embodiment of the process according to the invention a highly concentrated, conveniently reuseable size solution is obtained whilst, at the same time, the size is completely removed from the textile material by initially subjecting the textile material to a further treatment with water after it has passed through the steaming zone, the concentrated size solution which accumulates and the dilute aqueous size solution which remains on the textile material subsequently being displaced therefrom by the action of the organic solvent.

The aqueous size solution displaced from the textile material by the action of the organic solvent (in contrast to the concentrated size solution previously run off, this size solution has a relatively low concentration) may with advantage be returned to the first stage of the process and used there as the first liquid for treating the textile material (i.e., for prewetting the textile material).

The particular organic solvent used must be one that is compatible with and non-injurious to the textile material. Generally speaking, chlorinated hydrocarbons, flourinated hydrocarbons, and hydrocarbons themselves may be used, particularly 1:1:1 - trichloroethane (methylchloroform), perchloroethylene, trichlortrifluorethane, 1:1:2 - trichloro-1:2:2 - trifluoroethane, and mixtures thereof may be used, as well as other suitable organic solvents known in the art.

Further advantages of the process according to the invention are described in detail in the following in conjunction with the description of the embodiments illustrated in the accompanying drawings.

Figure 2:
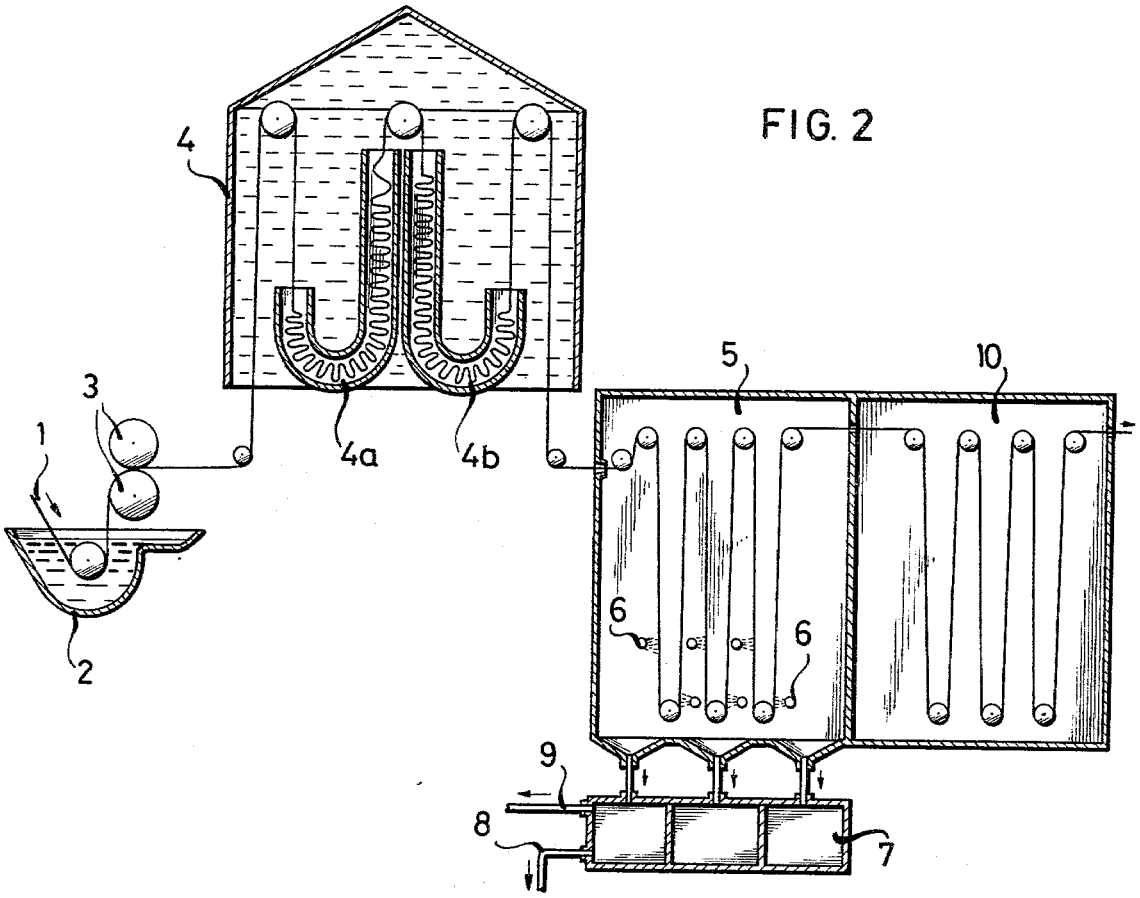
Figure 3:
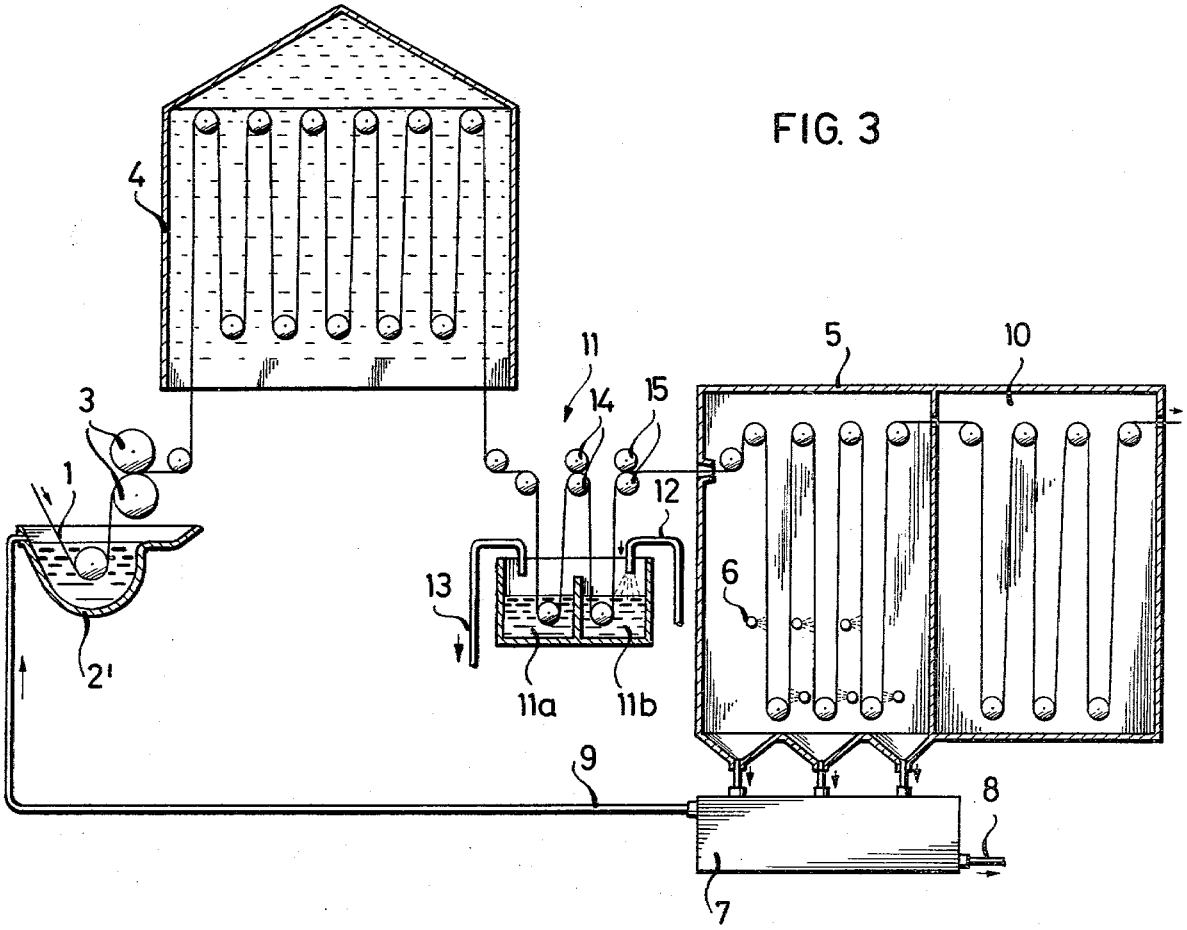

In the drawings,

FIGS. 1 to 3 diagrammatically illustrate three exemplary embodiments of an installation for carrying out the process according to the invention.

The installation shown in FIG. 1 is used for removing water-soluble polymers from a web 1 of textile material. This web 1 initially passes through a waterbath 2 which may optionally contain a wetting agent. After passing through squeezing rollers 3 (such as Foulard rollers), the web 1 enters and passes back and forth through a steamer 4 which, in the embodiment illustrated, is in the form of a roll steamer. However, it is also possible in accordance with the invention to use numerous other types of steamer constructions (for example rotor bar steamers, pilgrim step steamers, etc.). The important factor is that the web 1 should not be deposited in folds in the steamer. The steamer 4 is filled with saturated steam.

After leaving a steamer 4, the web 1 enters a chamber 5 in which an organic solvent immiscible with water is sprayed forcibly onto the web 1 through nozzles 6, as a result of which the water present in the web 1, together with the polymeric impurities dissolved therein, is mechanically or physically displaced from the web 1. The two immiscible liquids then enter a separator 7 in which the two liquids are separated simply on the basis of the difference in their specific gravities. The heavier organic solvent is run off at the lower end at 8, whilst the much lighter aqueous solution of the polymeric impurities (for example a size solution is run off at 9 and optionally reused).

The web 1 thus freed from the polymeric impurities then passes through a drying chamber 10 in which it is dried for example by means of an organic solvent.

As already mentioned, the water-soluble polymer (for example the water-soluble size) is effectively swollen and almost completely dissolved in the time taken by the web 1 to pass through the steam chamber 4 where it is exposed to the action of the saturated steam, so that these impurities are subsequently removed almost completely from the web during the mechanical displacement of the water from the web 1 by the organic solvent.

FIG. 2 shows a modification of the installation illustrated in FIG. 1 which may be used for removing impurities (such as starch size) which, although insoluble in water, can be degraded enzymatically or by oxidation. In this case, the waterbath 2 contains additives such as enzymes sensitive to high temperatures or peroxides suitable for degrading the impurities. In this embodiment, the steamer 4 is provided with two substantially U-shaped dwell tanks 4*a*, 4*b*. Downstream from the steamer are a chamber 5 for spraying on the organic solvent, a separator 7 for separating the two liquids of different specific gravity, and a drying chamber 10. The basic function of this installation corresponds to that of the previously described embodiment.

FIG. 3 shows another variant of an installation suitable for carrying out the process according to the invention. This installation additionally performs the particular function of producing a particularly concentrated solution of the impurities in the first or aqueous solution (for example a particularly concentrated size solution) for the purposes of reuse.

The web 1 initially passes through a bath 2' which, in this case, is filled with an aqueous size solution (run off at 9 from the separator 10) rather than with fresh water. After passing through squeezing rollers 3, the web 1 enters the steamer 4 filled with saturated steam and is then delivered to an intermediate treatment zone 11 in which it is further treated with water. In the embodiment illustrated, the intermediate treatment zone 11 consists of two stages 11*a* and 11*b*, fresh water being delivered at 12 to the second stage 11*b*, whilst the concentrated size solution formed in the intermediate treatment zone 11 by substantial removal of the impurities from the web 1 is run off from the stage 11*a* at 13. In the intermediate treatment zone 11, therefore, the impurities (for example size) present in the web 1 are substantially removed in several stages on the countercurrent principle. In order to promote the removal of these impurities in the intermediate treatment zone 11, squeezing rollers 14, 15 are provided between, after, or both, the individual stages.

The web 1 then enters the chamber 5 in which the now highly dilute aqueous size solution which is still present in the web 1 is mechanically displaced by spraying on organic solvent. After separation in the separator 7, this aqueous solution with a relatively low size concentration is returned to the bath 2' where it is used for prewetting the web 1. The particular advantage of the process carried out by the installation shown in FIG. 3 is that the concentrated size solution run off at 13 from the intermediate treatment zone 11 can be reused without any need for additional thickening. Another advantage is that the considerable dilution of the aqueous size solution present in the web 1 produced by the intermediate treatment zone 11 considerably facilitates its removal by the organic solvent in the chamber 5. This is because, since some of the polymeric impurities are highly viscous and a high viscosity prevents the "washing out," i.e. the mechanical displacement of this viscous liquid from the web 1, a considerable improvement in this washing-out effect is obtained by the previous dilution of the aqueous solution present in the web 1.

Fabric materials to which the process is applicable include synthetics such as polyesters or polyamides, cotton based polyesters, cellulose acetate-polyacrylonitriles and mixtures thereof with natural fibres, glass fibre cloth, cotton, and wool with mixtures of synthetic fibres of the kind referred to. The size may be one suitable for the particular fabric concerned, such as polyvinyl alcohol, carboxylated cellulose, carboxylated starch, and acrylate. In some instances the treatment bath preceding the squeeze rollers may include an alkali.

In some cases, it can be of advantage to carry out the treatment with water at elevated temperature in order to improve the dissolution or degradation of the polymeric impurities present in the textile material.

The invention is illustrated by the following Examples:

EXAMPLE 1

A woven fabric of cotton/polyester (55/45) weighing 140 g/m$^2$, which is provided with 6% of an acrylate size is treated at a speed of 60 meters per minute. To this end, 100% of an aqueous liquor containing 1 g/l of wetting agent is padded on at the squeezing rollers. The fabric is introduced into the steaming zone where it remains in the saturated steam for 30 seconds on account of the length of the steaming zone. The fabric is then introduced into the solvent zone where the size solution is washed out with perchlorothylene. The solvent adhering to the fabric is then dried off with hot air. The temperature of the liquor at the squeezing rollers is 20° C. for example.

EXAMPLE 2

A woven fabric of polyester/cotton (70/30) weighing 220 g/m$^2$, to which 6% of a polyvinyl alcohol size has been applied, is passed through the installation at a speed of 30 meters per minute. 120% of an aqueous liquor is padded on at the squeezing rollers. In addition to 1 g/l of wetting agent, the liquor contains 50 g/l thiourea. The fabric is introduced into the steaming zone where it remains for 60 seconds on account of the length of the steaming zone. The fabric is then introduced into the solvent zone without significant cooling and the size solution washed out with perchlorothylene. The temperature of the liquor at the squeezing rollers is 80° C. for example.

EXAMPLE 3

The same fabric as in Example 2 is treated in the same way with the following modifications: from the steaming zone, the fabric enters a water washing compartment in which the countercurrent is regulated in such a way that the fabric leaves the installation with a size content of 3%. The temperature of the liquor in the aqueous washing compartment is above 80° C. The fabric thus treated, which contains from 80 to 120% of a 3% size solution, is introduced into the solvent zone without significant cooling.

EXAMPLE 4

A 100% cotton fabric weighing 170 g/m$^2$ is provided with 18% of starch size. The fabric is passed through the installation at 50 meters per minute. 3 g/l of an enzyme are applied at the Foulard squeezing rollers, the enzyme only being activated under the conditions prevailing in the steaming zone. In addition, the recipe contains 1 g/l of wetting agent and 5 g/l of sodium chloride. The fabric is left in the steaming zone for 3 minutes; in this time the starch is enzymatically degraded. The fabric thus treated is then introduced into the solvent zone where the size is washed out with 1:1:1 - trichloroethane. The solvent present in the fabric is dried off in a drying zone.

EXAMPLE 5

A woven fabric of textured polyester filaments in the longitudinal and transverse directions contains 10% of acrylate size and has a weight of 200 g/m$^2$. The textile material is passed through the installation at 30 meters per minute. An aqueous liquor containing 1 g/l of wetting agent is applied at the Foulard squeezing rollers. The fabric remains in the steaming zone for about 3 minutes and is moved back and forth therein. This avoids the formation of transverse folds and initiates shrinkage. The textile fabric is then introduced into the solvent zone where the size solution is washed out with trichlotrifluorethane.

I claim:

1. A process for removing polymeric impurities from textile material comprising applying to said material an aqueous solution in which said impurities are soluble or degradable; exposing said material to saturated steam after the application of the aqueous solution for a period of between 10 seconds and 10 minutes while avoiding the depositing of said material in folds; and subsequently physically displacing said aqueous solution together with said impurities from said material by spraying into said material an organic solvent having a specific gravity greater than that of water and being immiscible with water.

2. A process as claimed in claim 1 including washing a quantity of said impurities from said material by subjecting said material to a further water treatment following the exposure of said material to said steam and prior to the exposure of said material to said solvent.

3. A process as claimed in claim 2 including collecting impurities washed from said material in said further water treatment in sufficient concentration for reuse thereof.

4. A process as claimed in claim 2 including reclaiming the impurities removed from the textile material by said organic solvent.

5. A process as claimed in claim 4 including delivering impurities reclaimed from said material to said aqueous solution.

6. A process as claimed in claim 2 wherein the further treatment of said material with water after steaming is conducted in several stages on the countercurrent principle.

7. A process as claimed in claim 6 including squeezing said material between successive stages of the further treatment with water.

8. A process as claimed in claim 1 including applying the aqueous solution to said material at a temperature above room temperature.

9. A process as claimed in claim 1 wherein said material comprises textured filaments of polyester or polyamide.

10. A process as claimed in claim 1 wherein said material comprises cotton-based fibres.

11. A process as claimed in claim 1 including applying to said material enzymes sensitive to high temperature prior to the exposure of the textile material to said steam.

12. A process as claimed in claim 1 wherein said textile material comprises polyester and cotton fibres.

13. A process as claimed in claim 12 wherein said aqueous solution contains polyvinyl alcohol size.

14. A process as claimed in claim 13 wherein the aqueous solution contains from 5 to 10% of urea or thiourea.

15. A process as claimed in claim 12 wherein the aqueous solution contains acrylate size.

16. A process as claimed in claim 15 wherein the aqueous solution contains an alkali.

17. A process as claimed in claim 12 wherein the aqueous solution contains size of the carboxylated cellulose or carboxylated starch type.

18. A process as claimed in claim 1 wherein said material comprises woven fabric of cellulose acetate, polyacrylonitrile and mixtures thereof with natural fibres.

19. A process as claimed in claim 1 wherein said material comprises wool and mixtures thereof with synthetic fibres.

20. A process as claimed in claim 1 wherein said material comprises glass fibre cloth.

21. A process as claimed in claim 1 wherein the aqueous solution contains an oxidising agent.

22. A process as claimed in claim 1 wherein the aqueous solution contains dye thickeners.

23. A process as claimed in claim 1 wherein said impurities are water soluble.

24. A process as claimed in claim 1 wherein said impurities are non-water soluble but are enzmatically degradable and wherein said aqueous solution contains an enzyme in which said impurities are degradable.

25. A process as claimed in claim 1 wherein said impurities are non-water soluble but are degradable by oxidation and wherein said aqueous solution contains an oxidation agent in which said impurities are degradable.

* * * * *